United States Patent [19]

Nakamura et al.

[11] Patent Number: 4,564,343

[45] Date of Patent: Jan. 14, 1986

[54] SCROLL COMPRESSOR HAVING IMPROVED SEALING

[75] Inventors: Toshiyuki Nakamura; Masahiro Sugihara; Tsutomu Inaba; Tadashi Kimura, all of Wakayama, Japan

[73] Assignee: Mitsubishi Denki Kabushiki Kaisha, Tokyo, Japan

[21] Appl. No.: 630,603

[22] Filed: Jul. 13, 1984

[30] Foreign Application Priority Data

Jul. 30, 1983 [JP] Japan ..... 58-139573
Nov. 15, 1983 [JP] Japan ..... 58-216761

[51] Int. Cl.[4] ..... F04C 18/04; F04C 27/00

[52] U.S. Cl. ..... 418/55; 418/142; 277/204

[58] Field of Search ..... 418/55, 142; 277/81 R, 277/81 P, 81 S, 149, 163, 204

[56] References Cited

U.S. PATENT DOCUMENTS

| | | | |
|---|---|---|---|
| 1,473,446 | 11/1923 | Scott | 277/163 |
| 2,007,691 | 7/1935 | Phillips | 277/149 |
| 3,134,600 | 5/1964 | Fisch | 418/142 |
| 3,820,925 | 6/1974 | Uchiyama et al. | 418/142 |
| 3,994,636 | 11/1976 | McCullough et al. | 418/55 |
| 4,437,820 | 3/1984 | Terauchi et al. | 418/55 |

*Primary Examiner*—John J. Vrablik
*Attorney, Agent, or Firm*—Sughrue, Mion, Zinn, Macpeak & Seas

[57] ABSTRACT

A scroll compressor having an improved sealing arrangement. Ends of scroll wraps opposite end plates are formed with grooves extending longitudinally along their spiral surfaces. Spring members are fitted into lower portions of these grooves, and tip seals in the upper portions, opposite and in contact with the end plate of the opposite scroll. In one embodiment, the grooves are divided by partitions into segments and separate springs are disposed in each segment. In another embodiment, the springs have a zig-zag shape.

1 Claim, 9 Drawing Figures

0°

270°

90°

180°

SCROLL COMPRESSOR HAVING IMPROVED SEALING

BACKGROUND OF THE INVENTION

The present invention relates to a scroll compressor employed as an air compressor, refrigerant compressor, or the like having an improved sealing arrangement.

FIGS. 1A to 1D show the basic components of a scroll compressor. In these drawings, reference numeral 1 designates a fixed scroll, 2 an orbiting scroll, 3 a discharge port, 4 compression chambers, 0 a fixed point on the fixed scroll 1, and 0' a fixed point on the orbiting scroll 2. The fixed scroll 1 and the orbiting scroll 2 are constituted by wraps of complementary (mirror-image) shapes, such as complementary involutes or the like.

The operation of the scroll compressor will next be described. In FIGS. 1A to 1D, the fixed scroll 1 is fixed in position relative to an external frame. The orbiting scroll 2 combined with the fixed scroll 1 as shown in the drawing, is moved in an orbiting pattern relative to the fixed scroll 1. Orbital positions at angles of 0°, 90°, 180° and 270° are shown in FIGS. 1A, 1B, 1C and 1D, respectively. The attitude of the orbiting scroll does not change with respect to the fixed scroll. As the scroll 2 undergoes its orbiting movement, the crescent-shaped compression chambers 4 gradually decrease in volume so that a fluid which has been taken into the compression chamber 4 at the beginning of the cycle is compressed and discharged through the discharge port 3. During this period, the distance between the fixed points 0 and 0' is constant, that is, $$00' = p/2 - t,$$

where p and t respectively represent the pitch of the two wraps and the thickness of each wrap.

In the scroll compressor described above, the seal used at a scroll-side end plate surface significantly affects the compression efficiency because of its length. Although various types of axial seals have been proposed, a tip seal is the most widely used because of its capability to compensate for increases in gap length due to thermal deformation. Such a seal is disclosed, for example, in U.S. Pat. No. 801,182, issued in 1905, Japanese Laid-Open Patent Application No. 117304/1976, and Japanese Published Patent Application No. 28240/1982.

U.S. Pat. No. 801,182 discloses a seal in which sealing material is inserted in a groove formed in an end surface of a scroll-side plate, extending along the spiral wrap. The seal material is urged outwardly by a spring in the axial direction to achieve sealing in the axial direction.

Japanese Laid-Open Patent Application No. 117304/1976 discloses a seal in which the width of a groove formed in an end surface of a scroll-side plate is made larger than that of a seal member and a high pressure fluid flows into the groove through a gap formed between the groove wall and the seal member so that the seal member is urged axially outwardly.

Further, Japanese Published Patent Application No. 28240/1982 discloses a seal in which a groove formed in an end surface of a scroll-side plate opens at one end into a high pressure region at the center portion of the spiral and a seal member inserted into the groove is urged axially outwardly by a high pressure fluid flowing into the groove through an opening formed at one end of the groove.

In the various kinds of tip seals described above, the use of a high pressure sealing fluid has a drawback in that the sealing fluid is apt to leak into the low pressure side of the compression chamber through the gap between the groove and the seal member. Compression losses due to such leakage cannot be disregarded. Further, due to a pressure gradient between the center portion and the outer peripheral portions of the spiral wraps, abrasion is likely to occur in the seal member in regions where the pressing force is strong and leakage in regions where the pressing force is weak. On the other hand, the structure using a spring to achieve sealing is complicated, leading to difficulties in the assembly of such a device.

SUMMARY OF THE INVENTION

An object of the present invention is thus to eliminate the drawbacks described above and to provide a seal for a scroll compressor which has a simple structure, is inexpensive, and in which a seal member is uniformly pressed so that fluid leakage is reduced and a high compression efficiency is achieved.

According to the present invention, in a scroll compressor, a groove formed in the end surface of a spiral wrap of a scroll is partitioned in the spiral longitudinal direction into a plurality of groove portions and elastic members are disposed in the groove portions between the partitions. Tip seals are urged against an end plate of a mating scroll by the force of the elastic members. The elastic members are prevented by the partitions from shifting in position and the seals are urged uniformly in the spiral longitudinal direction, making it possible to provide a sure axial seal with no fluid leakage. This arrangement provides an inexpensive and highly reliable seal device in which local abrasion is prevented from occurring and, consequently, a compressor having an improved reliability and assembly efficiency is attained.

DESCRIPTION OF THE PREFERRED EMBODIMENTS

Figure 1A:
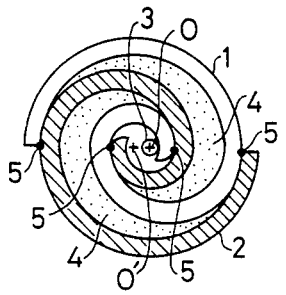
FIGS. 1A through 1D are diagrams used to illustrate the operating principles of a scroll compressor.
Figure 1D:
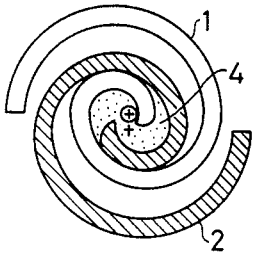
Figure 1B:
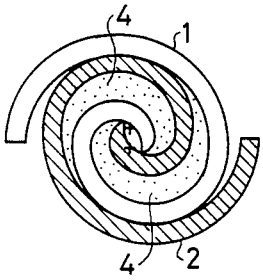
Figure 1C:
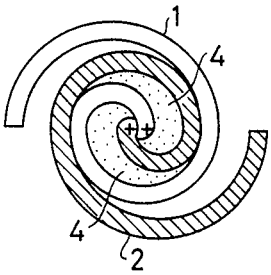
Figure 2:
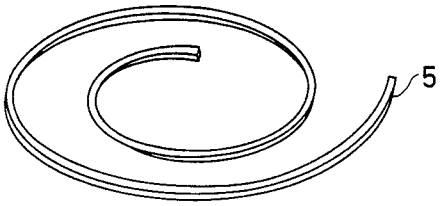
FIG. 2 is a diagram of a compressor scroll tip seal arrangement according to a preferred embodiment of the present invention.
Figure 2:
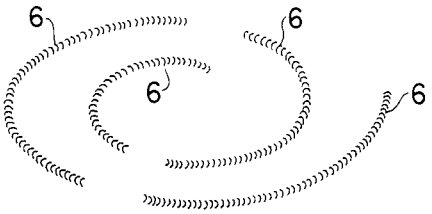
Figure 2:
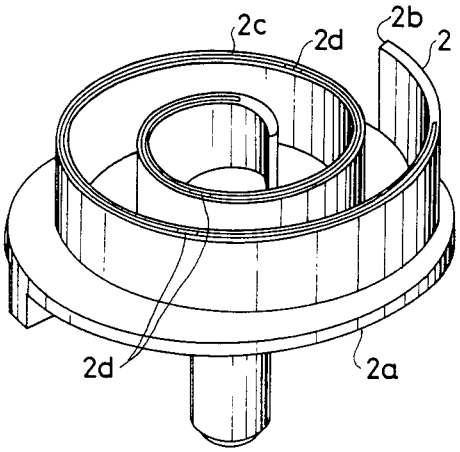
Figure 3:
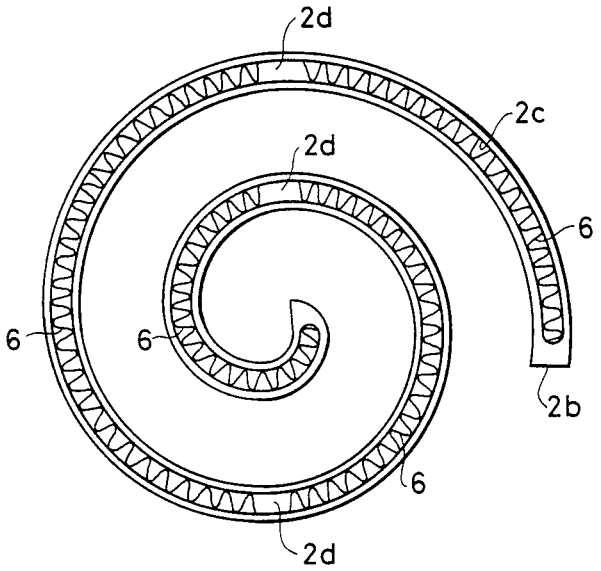
FIG. 3 is a diagram showing an arrangement of helical springs in the seal arrangement of FIG. 2.
Figure 4:
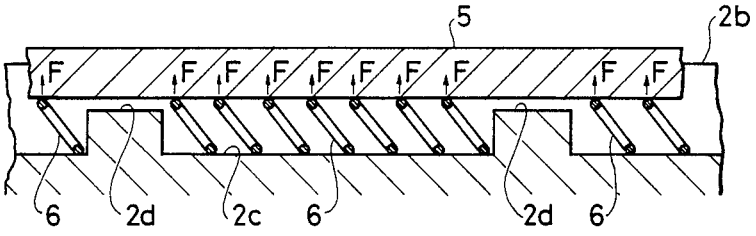
FIG. 4 is a longitudinal cross-sectional view taken along a spiral groove.

Referring to FIGS. 2 to 4, a preferred embodiment of a scroll compressor of the present invention will be described in detail. As shown in FIG. 2, a groove **2*c* is formed in the upper end surface of the wrap 2*b* of the orbiting scroll 2 opposite the end plate 2*a*. Partitions 2*d* are provided in the groove 2*c* at spaced intervals. Helical springs 6 are disposed in the groove 2*c* between the partitions 2*d*. The helical springs 6 are dimensioned such that each spring 6 projects somewhat upwardly beyond the partition 2*d*. A tip seal 5, which is a spiral seal member, is disposed above the springs 6 in the groove 2c**.

FIG. 3 is a top view showing the arrangement of the helical springs 6 in the groove 2c before the tip seal is inserted.

FIG. 4 is a cross-sectional view taken in the longitudinal direction of the spiral groove 2c. As shown in this drawing, the thickness of the tip seal 5, the diameter of the helical spring 6, and the depth of the groove 2c are such that the seal 5 projects somewhat from the the groove 2c when the seal 5 is fitted into the groove 2c. The amount of this projection should be larger than the axial gap formed between a fixed scroll 1 and the orbiting scroll 2 when the scrolls are assembled together. In the assembled state, the tip seal 5 is urged to close the axial gap by the force (indicated by an arrow F) of the helical spring 6. In this manner, even axial sealing is obtained.

The partitions 2d are provided in such a manner that the opposite ends of each helical spring 6 closely contact the partitions 2d so that the helical springs 6 are prevented from shifting in the groove 2c upon an internal pressure variation or slight movement of the tip seal 5 during the operation of the compressor.

The spring force F is uniformly distributed along the helical spring as shown in FIG. 4 so that the tip seal 5 provides axial sealing uniformly in the longitudinal direction. Accordingly, local abrasion and leakage due to an unequal sealing force are prevented from occurring. Further, due to the presence of the partitions 2d, shifting of the springs in the groove 2c is prevented and the assembly of the device is facilitated.

As explained before in conjunction with the compression principle shown in FIG. 1, in the scroll compressor, inherently, a high pressure is kept at a spiral central portion and a low pressure is kept at a peripheral side. Therefore, if a gap exists along the spiral longitudinal direction between the seal element 5 and the groove 2c, a compressed fluid tends to leak along the gap from the high pressure region on the spiral center side to the low pressure region on the spiral outer side. In particular, if the spring 6 is interposed in the groove 2c, a space for receiving it is required and the gap will essentially increase. The partitioning wall 2d is very effective for avoiding an increase of leakage of fluid from such gap.

Figure 5:
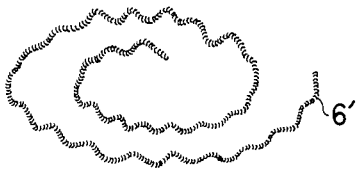
FIGS. 5 and 6 are views similar to the center and lower portions of FIG. 2 but showing an alternate embodiment of the invention.
Figure 6:
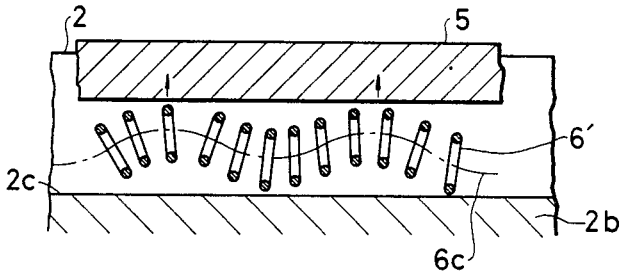

FIGS. 5 and 6 show another embodiment. In this embodiment, the center line of a helical spring 6' runs in a zig-zag along the groove 2c. FIG. 6 is a cross-sectional view of the helical spring fitted in the groove 2c of the orbiting scroll 2 together with the seal member 5 forming the tip seal. In this case, the force F of the helical spring 6 is transmitted to the seal member 5 through the crest portions of the zig-zag helical spring 6' to provide the axially acting sealing force. The force F is smaller than that provided in the embodiment of FIG. 3 for a helical spring of the same coil diameter and coil pitch.

Further, an elastic member formed into a zig-zag shape can be used in place of the helical spring 6 with the same effect.

Although description has been made above with respect to the tip seal arrangement of the orbiting scroll, the tip seal arrangement of the fixed scroll is essentially the same.

We claim:

1. A scroll compressor having improved sealing, comprising:

(a) a fixed scroll comprising a spiral wrap projecting from an end plate;

(b) an orbiting scroll comprising a spiral wrap projecting from an end plate, said fixed and orbiting scrolls being assembled together to form compression chambers between said fixed scroll and said orbiting scroll, a fluid introduced into said compression chamber being compressed toward a center portion of said fixed and orbiting scrolls and discharged through a discharge port formed at said center portion as said orbiting scroll undergoes an orbiting motion with respect to said fixed scroll, a groove being formed in end surfaces of said spiral wraps of each of said fixed and orbiting scrolls adjacent the end plate of the other scroll;

(c) seal members having generally the same shape as said grooves and being inserted in said grooves of said fixed and orbiting scrolls;

(d) each said groove of each of said fixed and orbiting scrolls being longitudinally divided into a plurality of groove portions by partitions, each partition having a height less than the depth of the groove, the partitions being widely spaced apart and relatively small such that the groove portions between partitions constitute nearly the entirety of the groove; and (e) a plurality of longitudinally aligned helical springs, one in each groove portion filling the groove portion from end to end; the turns of said springs abutting said seal member inserted in said groove and applying a force thereto which is directed outwardly from said groove bottom and is substantially uniform over the length of said seal member.

* * * * *